US007835906B1

(12) United States Patent
Miao et al.

(10) Patent No.: US 7,835,906 B1
(45) Date of Patent: Nov. 16, 2010

(54) ENCODING METHOD, APPARATUS AND DEVICE AND DECODING METHOD

(75) Inventors: Lei Miao, Shenzhen (CN); Fengyan Qi, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 12/790,345

(22) Filed: May 28, 2010

(30) Foreign Application Priority Data

May 31, 2009 (CN) ..... 2009 1 0107564

(51) Int. Cl.
*G10L 19/02* (2006.01)
*G10L 19/12* (2006.01)
*G10L 19/00* (2006.01)

(52) U.S. Cl. ..... 704/229; 704/219; 704/221

(58) Field of Classification Search ..... None
See application file for complete search history.

(56) References Cited

U.S. PATENT DOCUMENTS

| | | | | |
|---|---|---|---|---|
| 6,625,226 | B1 * | 9/2003 | Gersho et al. | 375/285 |
| 6,691,084 | B2 | 2/2004 | Manjunath et al. | |
| 6,757,649 | B1 * | 6/2004 | Gao et al. | 704/222 |
| 6,940,967 | B2 | 9/2005 | Makinen et al. | |
| 7,136,812 | B2 | 11/2006 | Manjunath et al. | |
| 7,536,305 | B2 | 5/2009 | Chen et al. | |
| 7,552,048 | B2 | 6/2009 | Xu et al. | |
| 7,577,567 | B2 | 8/2009 | Ehara et al. | |
| 7,593,852 | B2 | 9/2009 | Gao et al. | |
| 7,613,606 | B2 * | 11/2009 | Makinen | 704/221 |
| 2005/0256701 | A1 | 11/2005 | Makinen | |
| 2007/0016418 | A1 | 1/2007 | Mehrotra et al. | |
| 2009/0024386 | A1 | 1/2009 | Su et al. | |

FOREIGN PATENT DOCUMENTS

| | | | |
|---|---|---|---|
| CN | 1331826 | A | 1/2002 |
| CN | 1426629 | A | 6/2003 |
| CN | 101091108 | A | 12/2007 |
| EP | 1164580 | A1 | 12/2001 |
| EP | 1396843 | A1 | 3/2004 |
| EP | 1747442 | | 1/2007 |
| EP | 1770915 | A1 | 4/2007 |
| EP | 1141947 | B1 | 2/2009 |

* cited by examiner

*Primary Examiner*—Matthew J Sked
(74) *Attorney, Agent, or Firm*—Conley Rose, P.C.; Grant Rodolph

(57) ABSTRACT

The present invention relates to encoding technology. The encoding method includes selecting a second encoding mode for encoding an input frame signal according to an analysis on signal characteristic of the input frame signal; obtaining coding demand values for a preset first encoding mode and the second encoding mode which are used to encode the input frame signal; determining, from the above encoding modes based on the coding demand values, an encoding mode for encoding the input frame signal; and multiplexing information of the determined encoding mode and encoded data which are encoded according to the determined encoding mode. Hence, the compatibility and the prioritization in terms of the encoding modes can be achieved.

18 Claims, 7 Drawing Sheets

ENCODING METHOD, APPARATUS AND DEVICE AND DECODING METHOD

CROSS-REFERENCE TO RELATED APPLICATION

This application claims priority to Chinese Patent Application No. 200910107564.4, filed on May 31, 2009, which is hereby incorporated by reference in its entirety.

FIELD OF THE INVENTION

The present invention relates to the signal encoding and decoding field, and more specifically, to signal compressing technology, especially an encoding method, an encoding apparatus, an encoding device and a decoding method.

BACKGROUND

Lossless compression techniques may effectively enhance the coding efficiency since it saves the bandwidth and generates a lossless re-constructed signal. However, due to the inherent entropy between signals, the compression efficiency for different signals varies significantly with different compression solutions, and there is a high requirement for complexity in real-time transmission. Therefore, it is generally hard to further realize the tradeoff between the coding efficiency and the complexity, as well as the adaptation for different signals.

The existing lossless compression technique is mainly applicable to audio storage so as to acquire a higher compression ratio. However, such application brings higher complexity. In another technique, every sample of the signal is compressed and encoded so as to acquire a larger compression ratio. However, when every sample of different input signals is compressed in the same compression mode, the signal characteristics are neglected and it is highly possible that the compression mode which is not suitable for the input signal is used to compress and encode the input signal. Thus, the compression efficiency is degraded severely. In a worse situation, the signal may not even be able to be compressed and encoded.

SUMMARY

The present invention is directed to an encoding method, an encoding apparatus, a decoding method, and a decoding device. By introducing a generic encoding/decoding method for different input signals, the compression efficiency for different input signals is enhanced with a lower complexity.

To this end, an audio encoding method is provided according to an embodiment of the present invention. The method includes: selecting a second encoding mode for encoding an input frame signal according to an analysis on signal characteristics of the input frame signal; obtaining coding demand values for a preset first encoding mode and the second encoding mode which are used to encode the input frame signal; determining, from the above encoding modes based on the coding demand values, an encoding mode for encoding the input frame signal; and multiplexing information of the determined encoding mode and encoded data which are encoded according to the determined encoding mode.

Accordingly, a device, method, and apparatus according to various embodiments of the present invention are introduced to accommodate different encoding modes. By using a generic encoding method, a generic encoding apparatus, and a generic encoding device, effective switching is performed among different encoding modes based on the input signal frame and different encoding policy when a signal is compressed and encoded. Accordingly, different requirements for complexity and compression efficiency can be met. Therefore, the compression efficiency is effectively enhanced by sacrificing less complexity.

BRIEF DESCRIPTION OF THE DRAWINGS

A brief introduction of the accompanying drawings used in the description of the embodiments or the conventional art will be made below to provide further understanding of the technical solutions in the embodiments of the present invention or in the conventional art. Apparently, the accompanying drawings in the description below only illustrate some embodiments of the present invention. And it is readily appreciated by those skilled in the art that other drawings can also be made based on the accompanying drawings without creative work.

DETAILED DESCRIPTION

The technical solutions concerning the embodiments of the present invention will become more readily appreciated by reference to the following detailed description, when taken in conjunction with the accompanying drawings in the embodiments of the present invention. Apparently, the embodiments described herein are only a part of the embodiments of the present invention rather than exhaustive. It is readily appreciated by those skilled in the art that any other embodiments contemplated without creative work based on the embodiments of the present invention shall be construed as falling within the scope of the present invention.

First Embodiment of an Encoding Apparatus

Figure 1:
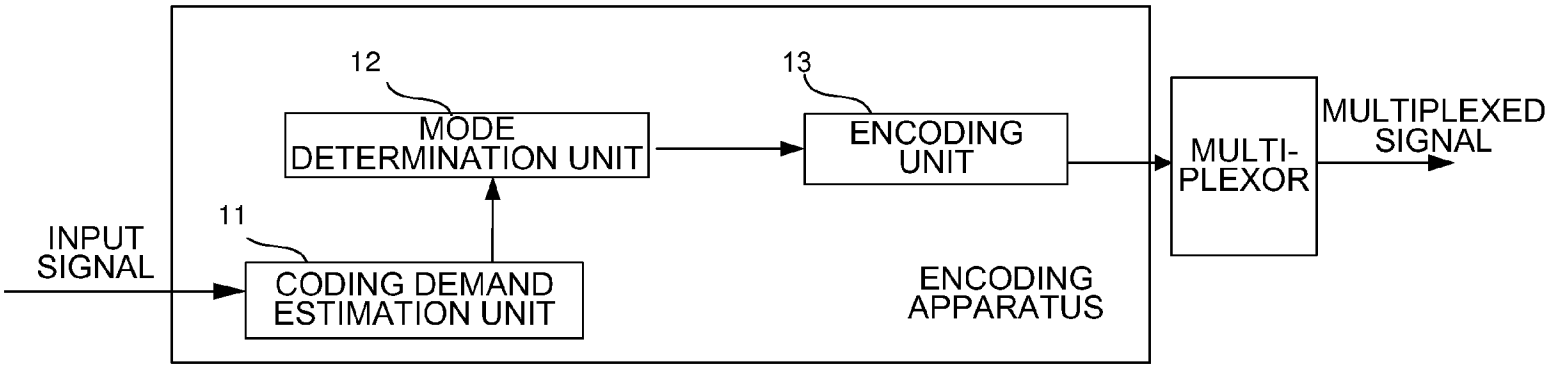
FIG. 1 is a block diagram of an encoding apparatus according to an embodiment of the present invention.

FIG. 1 is a block diagram of an encoding apparatus according to an embodiment of the present invention. As illustrated in FIG. 1, the encoding apparatus may include a coding demand estimation unit 11, a mode determination unit 12, and an encoding unit 13. The coding demand estimation unit 11 is configured to estimate coding demand values for a first encoding mode and at least one of the other encoding modes which are used to encode an input frame signal. The mode determination unit 12 is configured to determine, from the above encoding modes based on the coding demand value obtained by the coding demand estimation unit 11, an encoding mode used to encode the input frame signal in accordance with a mode selection policy. The encoding unit 13 is configured to encode the input frame signal using the encoding mode determined by the mode determination unit 12.

According to the present embodiment, an encoding apparatus is introduced to accommodate different encoding modes. By using a generic encoding apparatus and determining the coding demand value for the first encoding mode and at least one of the other encoding modes, effective switching is performed among different encoding modes based on the input signal frame and different encoding policies when a signal is compressed and encoded. Accordingly, different requirements for complexity and compression efficiency can be met. Therefore, the compression efficiency is effectively enhanced by sacrificing less complexity.

Second Embodiment of an Encoding Apparatus

Figure 2:
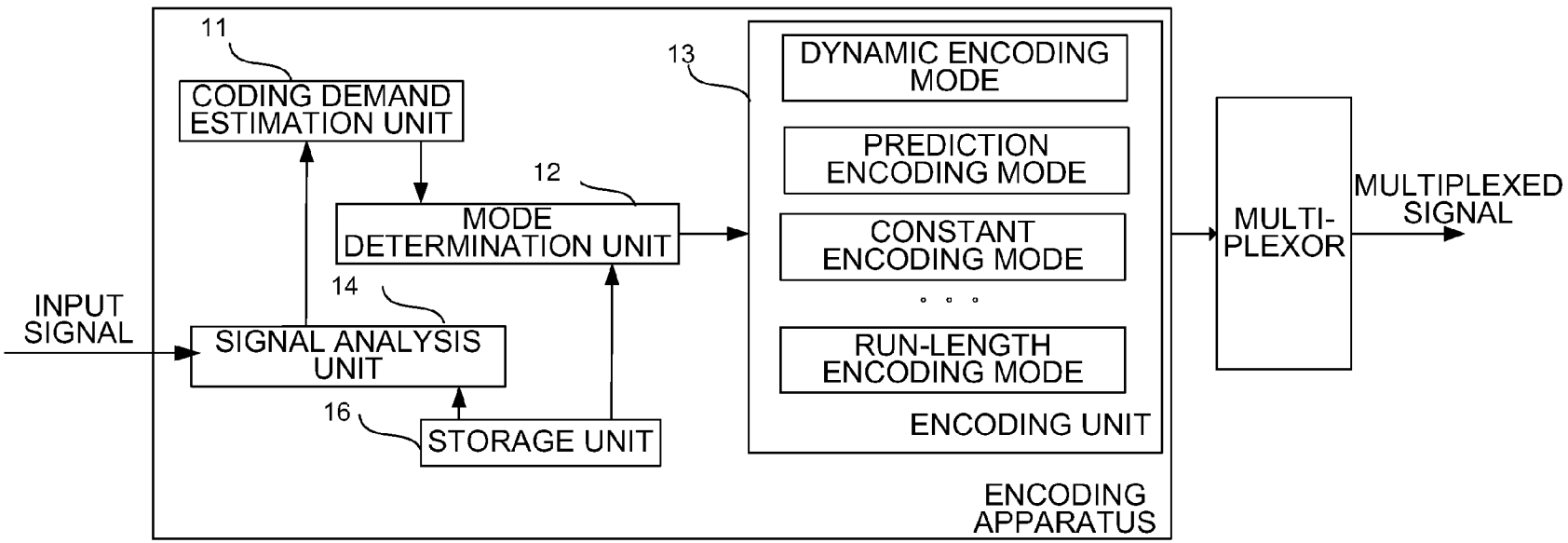
FIG. 2 is a block diagram of an encoding apparatus according to an embodiment of the present invention.

FIG. 2 is a block diagram of an encoding apparatus according to an embodiment of the present invention. As illustrated in FIG. 2, the encoding apparatus may include a coding demand estimation unit 11, a mode determination unit 12, and an encoding unit 13. The coding demand estimation unit 11 is configured to estimate coding demand values for a first encoding mode and at least one of the other encoding modes which are used to encode an input frame signal. The mode determination unit 12 is configured to determine, from the above encoding modes based on the coding demand value obtained by the coding demand estimation unit 11, the encoding mode used to encode the input frame signal in accordance with a mode selection policy. The encoding unit 13 is configured to encode the input signal frame using the encoding mode determined by the mode determination unit 12.

The input signal frame enters the coding demand estimation unit 11 frame by frame. The coding demand estimation unit 11 receives the input signal frame and estimates coding demand values for at least two encoding modes used to encode the input signal frame. The first encoding mode may be a dynamic range encoding mode. The at least one of the other encoding modes includes an encoding mode which differs from the dynamic range encoding mode. When the other encoding modes are of one type, the other encoding mode may be a prediction encoding mode. The at least one of the other encoding modes may include, but are not limited to, a prediction encoding mode, a constant encoding mode, a run-length encoding mode or a pulse encoding mode. The coding demand value includes the number of bits required by different encoding modes to encode the input frame signal and/or the number of bytes required to encode the input frame signal. The coding demand value may be obtained by using different encoding modes to perform encoding or by making estimation based on the parameter information of the input signal frame in combination with the characteristic of the encoding mode. Accordingly, if the coding demand value is obtained by using different encoding modes to encode the input signal frame, the encoding unit 13 may be disposed within the coding demand estimation unit 11 or may be in a logic entity together with the coding demand estimation unit 11 or may be a separate logic entity. If the coding demand value is estimated based on the parameter information of the input signal frame, the encoding unit 13 receives the output of the mode determination unit 12 and performs encoding according to the determined mode.

The encoding apparatus according to the present embodiment may further include a signal analysis unit 14. The signal analysis unit 14 is configured to select, before the input signal frame enters the coding demand estimation unit 11, a second encoding mode from the other encoding modes other than the first encoding mode based on the signal characteristic of the input frame signal in accordance with a signal analysis policy, wherein the second encoding mode serves as the at least one of the other encoding modes input to the coding demand estimation unit 11. When receiving the output of the signal analysis unit 14, the coding demand estimation unit 11 obtains the coding demand values for the first encoding mode and the second encoding mode separately which are used to encode the input frame signal.

The coding demand estimation unit 11 outputs coding demand values required by different encoding modes to encode the input signal frame. The mode determination unit 12 determines the mode for encoding the input signal frame according to a mode selection policy. The mode selection policy includes determining, from the obtained coding demand values, a minimum coding demand value; determining, from the obtained coding demand values, the coding demand value closest to the threshold; or adopting preferably one of the first encoding modes and at least one of the other encoding modes for performing encoding; generating an encoding mode identifier corresponding to the encoding mode and corresponding parameters required for encoding and sending the encoding mode identifier and the parameters to the encoding unit 13.

The encoding unit 13 encodes the input frame signal using the encoding mode determined by the mode determination unit 12. Alternatively, as stated before, the coding demand estimation unit 11 may encode the input frame signal in the process of obtaining coding demand values based on different encoding modes, the said encoded input frame signal may be reused by the encoding unit 13. The encoded signal includes encoded input frame signal, an encoding mode identifier, and parameters required by the encoding. In another embodiment, the encoded signal may further include other signal or information.

According to the present embodiment, an encoding apparatus is introduced to accommodate different encoding modes. By using a generic encoding apparatus and determining the coding demand values for the first encoding mode and at least one of the other encoding modes, effective switching is performed among different encoding modes based on the input signal frame and different encoding policies when a signal is compressed and encoded. Accordingly, different requirements for complexity and compression efficiency can be met. Therefore, the compression efficiency is effectively enhanced with less complexity.

Third Embodiment of an Encoding Apparatus

Figure 2A:
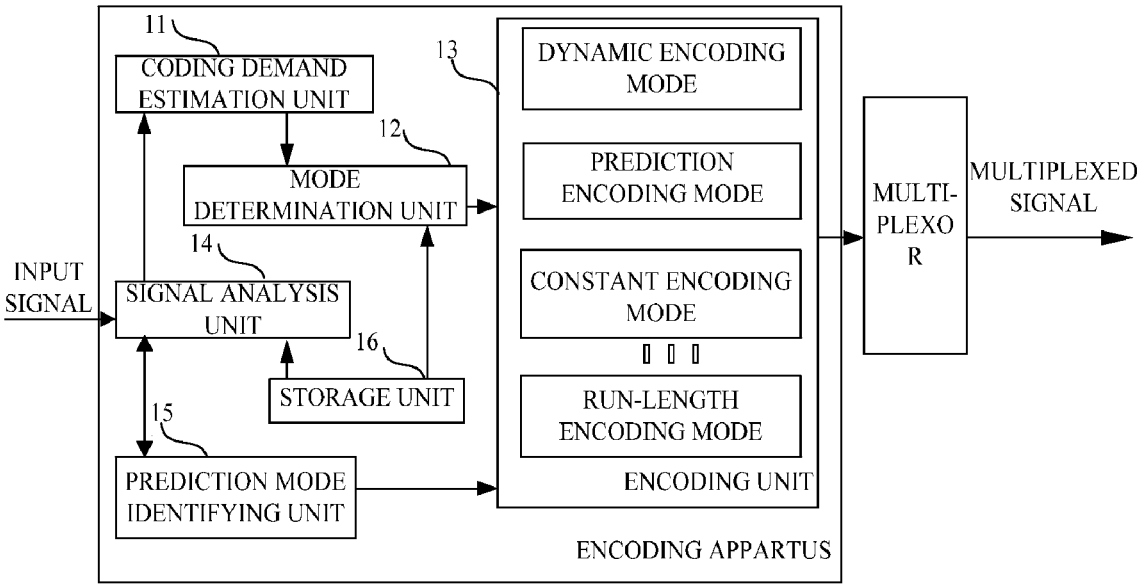
FIG. 2*a* is a block diagram of an encoding apparatus according to an embodiment of the present invention.

FIG. 2*a* is a block diagram of an encoding apparatus according to an embodiment of the present invention. The encoding apparatus includes a signal analysis unit 14, a coding demand estimation unit 11, a mode determination unit 12, and an encoding unit 13. The signal analysis unit 14 is configured to analyze the signal characteristic of the input frame signal and select a second encoding mode to encode the input frame signal. The coding demand estimation unit 11 is configured to estimate coding demand values for a first encoding mode and the second encoding mode which are used to encode an input frame signal. The mode determination unit 12 is configured to determine, from the encoding modes based on the coding demand values, an encoding mode for encoding the input frame signal. The encoding unit 13 is configured to encode the input frame signal using the determined encoding mode.

The signal analysis unit 14 is configured to analyze the input frame signal and select a second encoding mode from various encoding modes to encode the input frame signal. Different signal characteristics of the input signal frame may correspond to different encoding modes. The signal characteristic includes, but are not limited to, a constant signal, a special constant signal, a pulse signal, or a multi-valued signal with at least two values. The signal analysis unit 14 may select the second encoding mode in accordance with a signal analysis policy. The signal analysis policy includes analyzing various signal characteristics of the input frame signal, and selecting an encoding mode corresponding to the characteristic of the input frame signal. Take G.711 code stream signal as an example. If the input signal frame is determined to be a constant signal, a constant encoding mode is selected as a second encoding mode. If the input signal frame does not match the constant characteristic but the pulse information of the input signal frame meets a preset condition, a pulse encoding mode may be selected as a second encoding mode. The signal analysis policy may further include employing a prediction encoding mode for the input frame signal whose signal characteristic does not match any preset characteristics. When the analysis shows that no characteristic matches, for example, the input signal frame is neither a normal constant nor a special constant, and the input signal frame does not match a preset pulse number or the input signal frame is not a multi-valued signal, the prediction encoding mode is selected as a second encoding mode after analysis. The coding demand estimation unit 11 and the mode determination unit 12 in the present embodiment differ from those in the first embodiment of the encoding apparatus in the estimation of the coding demand value for the first encoding mode and the second encoding mode and in the determination on selecting an encoding mode between the first encoding mode and the second encoding mode. The encoding unit 13 in the present embodiment is identical with that in the first embodiment of the encoding apparatus.

Another difference with the first embodiment of the encoding apparatus is that the encoding apparatus of the present embodiment further includes a prediction mode identifying unit 15 for identifying whether the second encoding mode output from the signal analysis unit 14 is a prediction mode.

If the prediction mode identifying unit 15 identifies that the second encoding mode is not the prediction mode, the identified result is sent to the encoding unit 13. The encoding unit 13 employs the second encoding mode to encode the input frame signal. If the prediction mode identifying unit 15 identifies that the second encoding mode is a prediction mode, the identified result is sent to the coding demand estimation unit 11.

The mode selection policy and the signal analysis policy in the first and second embodiments of the encoding apparatus may be stored in the encoding apparatus via a storage unit 16 or may be read out. The storage unit may be a logic entity in the encoding apparatus or may be separate from the encoding apparatus such that the data information is read externally.

According to the present embodiment, an encoding apparatus is introduced to accommodate different encoding modes. By using a generic encoding apparatus, a second encoding mode for encoding the frame signal is selected based on an analysis on the signal characteristic. If the selected second encoding mode is not a prediction mode, the signal is encoded and output immediately. If the selected second encoding mode is a prediction mode, an optimal encoding mode will be selected based on the coding demand values for the first encoding mode and the second encoding mode which are used to encode the input frame signal. As such, effective switching is performed among different encoding modes based on the input signal frame and different encoding policies when a signal is compressed and encoded. Accordingly, different requirements for complexity and compression efficiency can be met. Therefore, the compression efficiency is effectively enhanced by sacrificing less complexity.

First Embodiment of an Encoding Method

Figure 3:
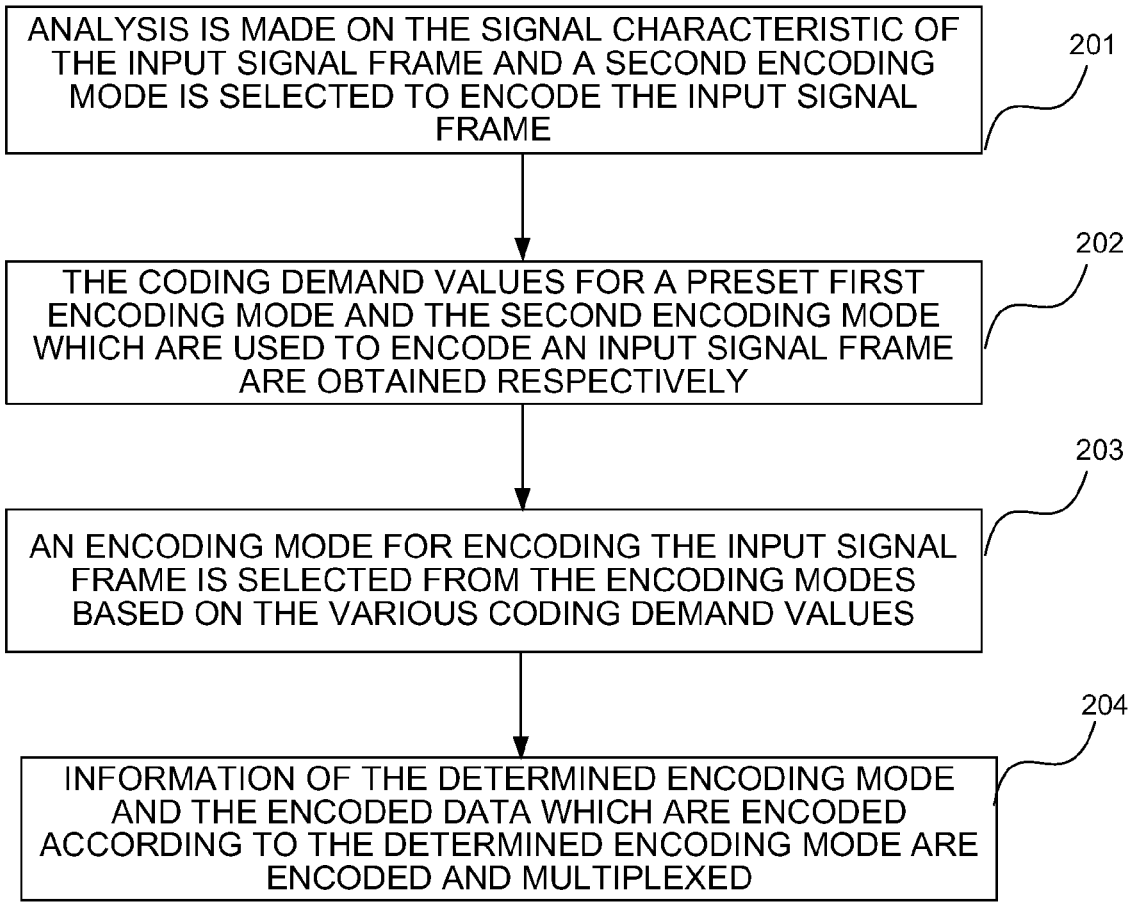
FIG. 3 is a flowchart of an encoding method according to an embodiment of the present invention.

FIG. 3 is a flowchart of an encoding method according to an embodiment of the present invention. The method includes the following steps.

Step 201: Analysis is made on the signal characteristic of the input frame signal and a second encoding mode is selected to encode the input frame signal.

The input signal frame to be encoded has various signal characteristics. Analysis is made on the characteristic of the input signal frame. Based on the analysis result, a second encoding mode is selected from various encoding modes for encoding the input signal frame. The input signal frame may be a pulse-code modulation (PCM) signal, or like a signal encoded point by point in accordance with G. 711 standard or other signals.

Step 202: The coding demand values for a preset first encoding mode and the second encoding mode which are used to encode an input frame signal are obtained.

The first encoding mode for encoding the input signal frame is preset. The first encoding mode may be in a dynamic range encoding mode. The coding demand values for the first encoding mode and the second encoding mode obtained at step 201 which are used to encode the input signal frame are estimated. The coding demand value is the number of bits or the number of bytes required to encode the input frame signal.

Step 203: An encoding mode for encoding the input frame signal is selected from the encoding modes based on the various coding demand values.

The calculated coding demand values under different encoding modes are compared in accordance with a certain policy. The encoding mode for encoding the input frame signal is selected thereof.

Step 204: Information of the determined encoding mode and the encoded data which are encoded according to the determined encoding mode are encoded and multiplexed.

In addition, some encoding parameters for conducting the encoding are also multiplexed so that the decoder is able to decode successfully.

According to the present embodiment, an encoding method is introduced to accommodate different encoding modes. By using a generic encoding method, a second encoding mode for encoding the frame signal is selected based on an analysis on the signal characteristic. An optimal encoding mode will be selected based on the coding demand value for the first encoding mode and the second encoding mode which are used to encode the input frame signal. As such, effective switching is performed among different encoding modes based on the input signal frame and different coding policy when a signal is compressed and encoded. Accordingly, different requirements for complexity and compression efficiency can be met. Therefore, the compression efficiency is effectively enhanced by sacrificing less complexity.

Second Embodiment of an Encoding Method

Figure 4:
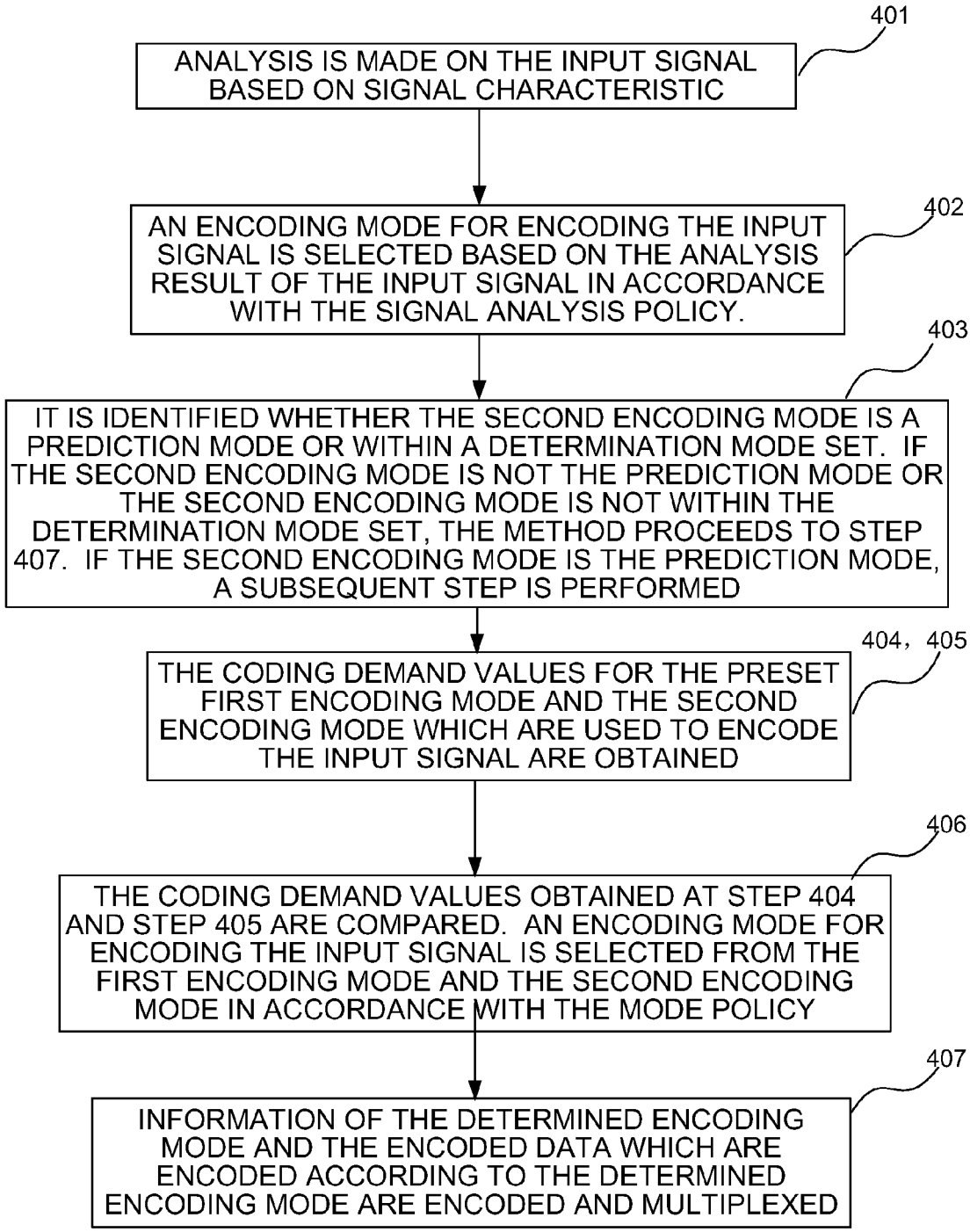
FIG. 4 is a flowchart of an encoding method according to an embodiment of the present invention.

FIG. 4 is a flowchart of an encoding method according to an embodiment of the present invention. The method includes the following steps.

Step 401: Analysis is made on the input signal frame based on signal characteristics.

The input signal frame has various signal characteristics. In the present embodiment, firstly, the signal characteristic of the input signal frame is analyzed. The signal characteristic of the input signal frame includes whether the whole input frame signal is a constant signal. If the signal is a constant signal, it is further determined whether the constant is a special constant. The signal characteristic of the input signal frame may also include whether the whole input frame signal has two or more values, or the number of pulses of the input signal frame. The signal characteristics of the input signal frame are not limited to the above types. The signal characteristics of the input signal frame includes all the signal characteristics which can reflect the signal characteristic.

Figure 5:
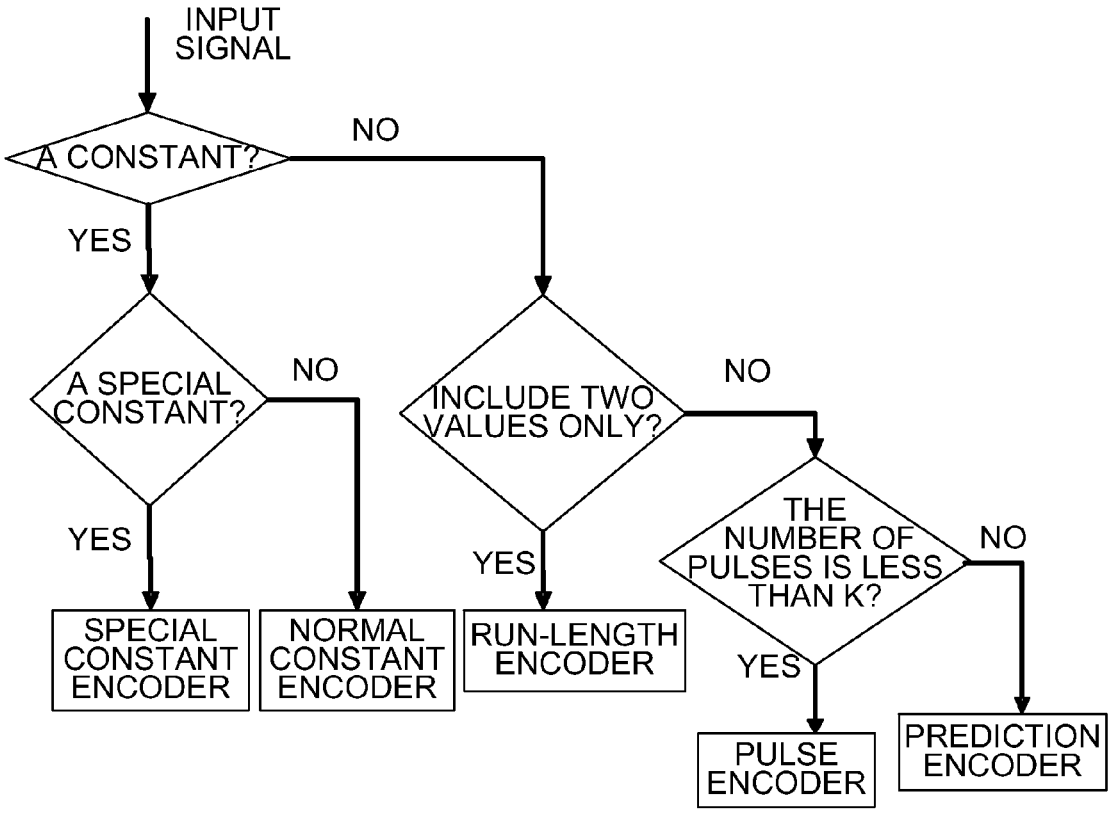
FIG. 5 is a determination process for a signal analysis policy according to the embodiment of the encoding method of the present invention.

Step 402: An encoding mode for encoding the input signal frame is selected based on the analysis result of the input signal frame in accordance with the signal analysis policy. Such encoding mode is referred to as a second encoding mode. Different signal characteristics correspond to different encoding modes. By analyzing the input signal frame, the encoding mode for the input signal frame may be determined in accordance with a preset signal analysis policy. As shown in FIG. 5, the signal analysis policy may include analyzing various signal characteristics to select a second encoding mode; taking priority to conduct the selection based on the analysis result. For instance, it is first determined if the signal is a constant signal. Then it is determined if the signal is a multi-value signal. Lastly, it is determined if the signal is a pulse signal. The determination process may be as follows. Based on the analysis result obtained at step 401, it is first determined whether the input signal frame is a constant signal. When the whole input frame signal is a constant signal, a corresponding constant encoding mode is selected as the second encoding mode. Alternatively, it is further determined whether the frame signal is a special constant frame signal. If it is a special constant frame signal, a special constant encoding mode is selected; otherwise, a normal constant encoding mode is selected. If the signal is not a constant signal, it is determined if the signal is a multi-valued signal. If the whole input signal frame includes two values, a multi-valued encoding mode is selected as the second encoding mode. The rest may be deduced by analogy until the determination of the signal characteristic is completed. The above sequence for determination may also be adjusted according to a real situation. The signal analysis policy includes the priority of determination of different signal characteristics and determination on which signal characteristic needs to be analyzed. The corresponding encoding modes include, but are not limited to, a constant encoding mode, a pulse encoding mode, a multi-valued encoding mode or a run-length encoding mode. For the signal whose signal characteristic does not comply with a preset characteristic, a prediction encoding mode is used as the second encoding mode. FIG. 5 illustrates a determination process based on the signal analysis policy.

Step 402 may also be performed concurrently to step 401. After an analysis to one signal characteristic, it may be determined based on the signal analysis policy whether the encoding mode corresponding to the signal characteristic can be selected as the second encoding mode. Step 402 may also be performed on the basis of the completion of step 401 to select the second encoding mode in accordance with the signal analysis policy. The above steps may allow for effectively selecting an encoding mode based on the signal characteristics so that the compressing efficiency is further guaranteed.

Step 403: It is identified whether the second encoding mode is a prediction mode. If the second encoding mode is not the prediction mode, the method proceeds to step 407. If the second encoding mode is the prediction mode, a subsequent step is performed.

Step 404: The coding demand value for the preset first encoding mode which is used to encode the input signal frame is obtained.

Step 404 may be implemented in at least two ways. The first way is to encode the input frame signal frame by frame with the first encoding mode and calculate the coding demand value required for encoding. The second way is to estimate the coding demand value required for encoding the input frame signal frame by frame with the first encoding mode and obtain an estimate for the coding demand value.

The first encoding mode may be a dynamic range encoding mode. The coding demand value for the dynamic range encoding mode may include the number of bits or the number of bytes required for encoding. The number of bits or the number of bytes is used to represent the characteristic information of the complexity for encoding the input signal frame. The present embodiment is described in an example of the number of bits. The number of bits required for encoding each sample point is calculated based on the minimum sample point value and the maximum sample point value of the signal to be encoded. For instance, based on the obtained maximum sample point value max(x) and the minimum sample point value min(x) of the signal x to be encoded, the number of bits "code_bits" required for encoding each sample point may be obtained by the following formula: $code_bits=\log_2[(\max(x)-\min(x)+1)]$. Alternatively, determination may be performed prior to step 404 to obtain the dynamic range of the signal to be encoded. The dynamic range is compared with a predetermined threshold. When the dynamic range of the signal to be encoded is smaller than or equal to the preset threshold, step 404 is performed. Or, the dynamic range is below a threshold, or above a threshold, or below threshold 1 and above threshold 2, or the number of bits for the second encoding mode is higher than a threshold.

Step 405: The coding demand value for the second encoding mode which is used to encode the input signal frame is obtained. The step may be performed prior to step 404, after step 404 and/or performed concurrently to step 404. Similar to the method in step 404, the coding demand value for the second encoding mode which is used to encode the input signal frame is obtained in accordance with the method for calculating the number of bits or the number of bytes required for encoding the input signal frame using the second encoding mode. Alternatively, determination may be carried out prior to step 405. If the number of bits for the second encoding mode is larger than a threshold, step 406 is performed.

Step 406: The coding demand values obtained at step 404 and step 405 are compared. An encoding mode for encoding the input signal frame is selected from the first encoding mode and the second encoding mode in accordance with a mode selection policy.

The mode selection policy includes determining a minimum coding demand value from the obtained coding demand values. According to this mode selection policy, the first mode for encoding the input signal frame is selected if the coding demand value required for the first mode is less than the coding demand value required for the second mode. If the coding demand value required for the first mode is not less than the coding demand value required for the second mode, a second encoding mode is selected for encoding the input signal frame. The mode selection policy further includes determining, from the obtained coding demand values, a coding demand value which is closest to the threshold. According to this mode selection policy, the code demand values for these two modes are compared with a preset threshold. The encoding mode corresponding to the coding demand value having a smaller absolute value of the difference between the coding demand value and the threshold is selected for encoding the input signal frame. Alternatively, the encoding mode corresponding to the coding demand value smaller than the threshold is selected for encoding the input signal frame. The mode selection policy further includes adopting preferably one of the first encoding mode and at least one of the other encoding modes used to perform encoding. In different environments, sometimes, there is a need to perform encoding in a preset encoding mode. Therefore, the mode which is employed first still exists. Of course, the mode policy for selecting, from the first encoding mode and the second encoding mode, an encoding mode for the input signal frame is not limited to the above types. The mode selection policy covers all the solutions which can be conceived by those skilled in the art.

Step 407: Information of the determined encoding mode and the encoded data which are encoded according to the determined encoding mode are encoded and multiplexed.

If the method for calculating coding demand value by way of encoding is employed at step 404 and step 405, then, at step 407, the information of the first encoding mode and the encoding result at step 404 are multiplexed and encoded with the parameters required for the first encoding mode. The multiplexed data are then output to the decoder. Alternatively, the information of the second encoding mode and the encoding result at step 405 are multiplexed and encoded with the parameters required for the second encoding mode. The multiplexed data are then output to the decoder. If the coding demand value is obtained by the estimation method employed at step 404 and step 405, then, at step 407, the input signal frame is encoded frame by frame using the encoding mode determined at step 406 to obtain the encoded data. For the identified result which is as an input at step 403, the input signal frame is encoded and multiplexed based on the identified result.

The encoded input signal frame, the encoding mode identifier, and the parameters required for encoding are multiplexed. The parameters required for encoding includes the number of sample points, a minimum value of the sample points, and the number of bits for encoding each sample point. Also, the parameters may include a prediction coefficient, a prediction order, entropy coding parameters, etc., which are dependent on the selected encoding mode. The selected encoding mode is used to compress and encode the input signal frame.

If it is determined that the signal to be encoded employs a second encoding mode, an encoding mode identifier corresponding to the second encoding mode is generated and sent. The input signal frame is encoded using the second encoding mode via the second encoding module.

If it is determined that the signal to be encoded employs the first encoding mode, the input signal frame is encoded by a dynamic range encoding module (taking the dynamic range encoding module as an example). The frame header information of the signal to be encoded, the information of the sample point value of the signal to be encoded and the encoding mode identifier corresponding to the dynamic range encoding mode are sent. The frame header information is the minimum value of the sample point of the signal to be encoded and the number of bits for encoding each sample point. The information of the sample point value of the signal to be encoded is the sample point value of the signal to be encoded. The frame header information of the signal to be encoded is encoded based on the encoding mode identifier corresponding to the dynamic range encoding mode. The information of the sample point of the signal to be encoded is encoded bit by bit based on the number of bits required for encoding each sample point.

Alternatively, step 403 may include the following steps.

Step 403: It is identified whether the second encoding mode is one of the encoding modes in a determination mode set.

The determination mode set is preset. The determination mode set may include at least one encoding mode. The at least one encoding mode may be a prediction mode or other mode which differs from the first encoding mode. When the second encoding mode is selected at step 402, the second encoding mode is determined first. If the second encoding mode is not within the determination mode set, step 407 is performed to encode the input frame signal using the second encoding mode, and the information of the second encoding mode and the encoded data which are encoded using the second encoding mode are multiplexed; otherwise, a subsequent step is performed.

According to the present embodiment, an encoding method is introduced to accommodate different encoding modes. By using a generic encoding method, a second encoding mode for encoding the frame signal is selected based on an analysis on the signal characteristic. If the selected second encoding mode does not belong to the determination mode set, the signal is encoded and output immediately. If the selected second encoding mode is within the determination mode set, an optimal encoding mode will be selected based on the coding demand values for the first encoding mode and the second encoding mode which are used to encode the input frame signal. As such, effective switching is performed among different encoding modes based on the input signal frame and different coding policy when a signal is compressed and encoded. Accordingly, different requirements for complexity and compression efficiency can be met. Therefore, the compression efficiency is effectively enhanced by sacrificing less complexity.

Third Embodiment of an Encoding Method

Figure 6:
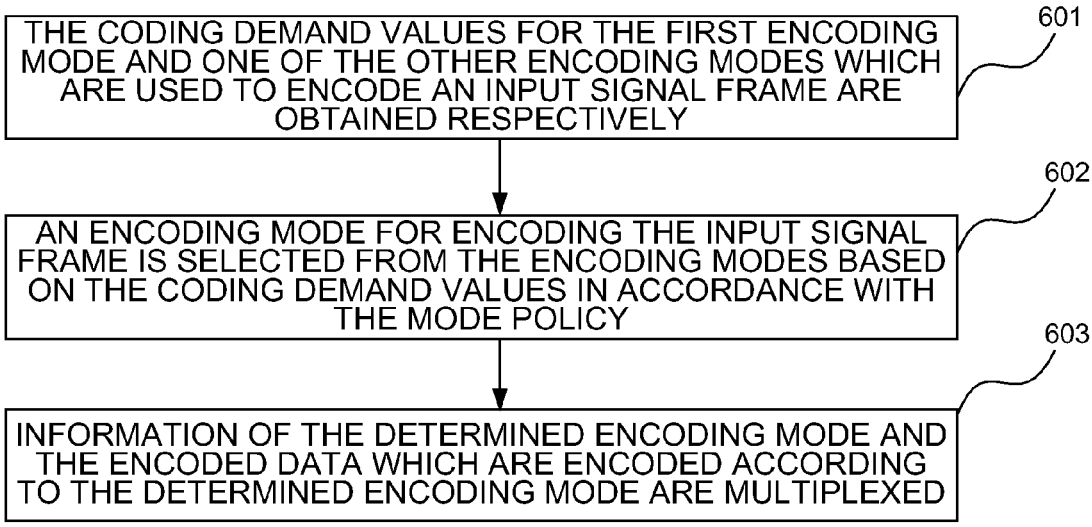
FIG. 6 is a flowchart of an encoding method according to an embodiment of the present invention.

FIG. 6 is a flowchart according to an embodiment of the present invention. The flowchart includes the following steps.

Step 601: The coding demand values for the first encoding mode and one of the other encoding modes which are used to encode an input frame signal are obtained.

The first encoding mode may be a dynamic range encoding mode. The at least one of the other encoding modes is another encoding mode differing from the dynamic range encoding mode. When the at least one of the other encoding modes includes only one mode, this mode can be a prediction mode. Of course, other encoding modes shall not be excluded.

Step 602: An encoding mode for encoding the input frame signal is selected from the encoding modes based on the coding demand values in accordance with the mode selection policy.

Step 603: Information of the determined encoding mode and the encoded data which are encoded according to the determined encoding mode are multiplexed.

In the present embodiment, coding demand values for different encoding modes are estimated directly. The encoding mode for encoding the input signal frame is selected therefrom, thereby reducing implementation complexity.

According to the present embodiment, an encoding method is introduced to accommodate different encoding modes. By using a generic encoding method and determining the coding demand values for the first encoding mode and the second encoding mode, effective switching is performed among different encoding modes based on the input signal frame and different coding policy when a signal is compressed and encoded. Accordingly, different requirements for complexity and compression efficiency can be met. Therefore, the compression efficiency is effectively enhanced by sacrificing less complexity.

Fourth Embodiment of an Encoding Method

Figure 7:
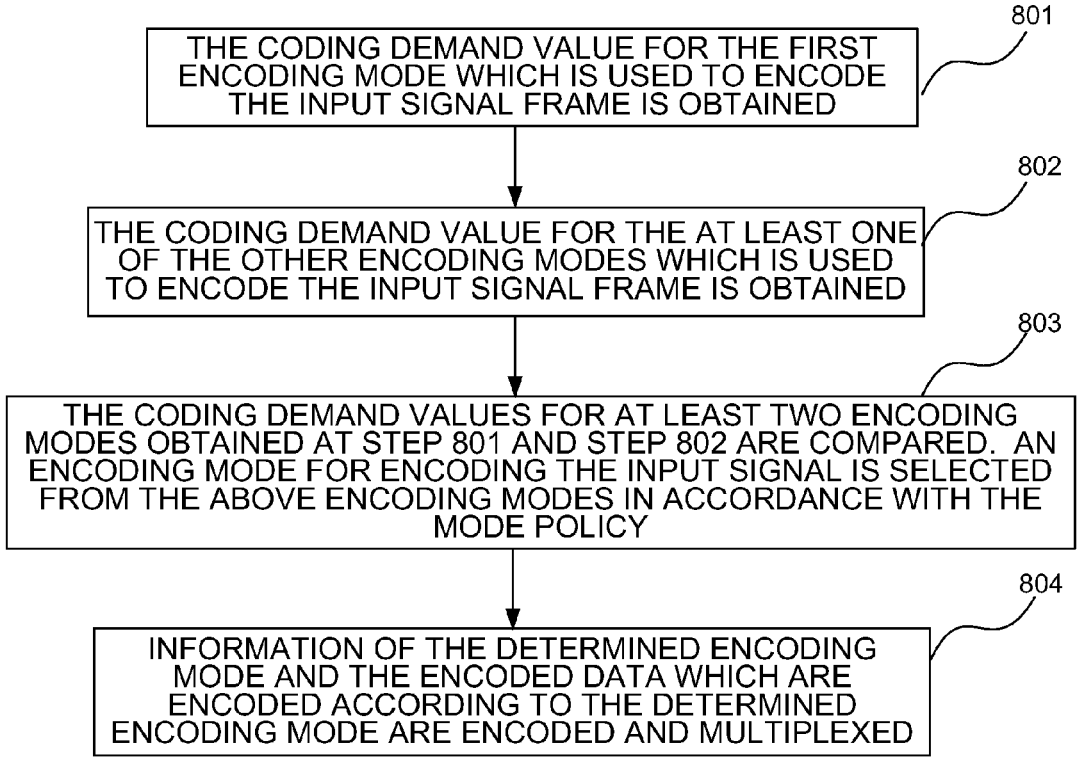
FIG. 7 is a flowchart of an encoding method according to an embodiment of the present invention.

FIG. 7 is a flowchart according to an embodiment of the present invention. The flowchart includes the following steps.

Step 801: The coding demand value for the first encoding mode which is used to encode the input frame signal is obtained.

Step 801 may be implemented in at least two ways. The first way is to encode the input frame signal by frame using the first encoding mode and calculate the coding demand value required for encoding. The second way is to estimate the coding demand value for the first encoding mode which is used to encode the input frame signal by frame and obtain an estimate for the coding demand value.

The first encoding mode may be a dynamic range encoding mode. The coding demand value for the dynamic range encoding mode may include the number of bits or the number of bytes required for encoding. The number of bits or the number of bytes is used to represent the characteristic information of the complexity for coding the input signal frame. The present embodiment is described in an example of the number of bits. The number of bits required for encoding each sample point is calculated based on the minimum sample point value and the maximum sample point value of the signal to be encoded. For instance, based on the obtained maximum sample point value max(x) and the minimum sample point value min(x) of the signal x to be encoded, the number of bits "code_bits" required for encoding each sample point may be obtained by the following formula: $code_bits=\log_2[(\max(x)-\min(x)+1)]$.

Step 802: The coding demand value for the at least one of the other encoding modes which is used to encode the input frame signal is obtained.

A coding demand value for an encoding mode differing from the dynamic range encoding mode which is used to encode the input signal frame is obtained. Similar to the method in step 801, the coding demand value for the second encoding mode which is used to encode the input signal frame is obtained in accordance with the method for calculating the number of bits or the number of bytes required by the other encoding mode. The coding demand value may include the number of bits or the number of bytes required for encoding. Take the prediction encoding mode as an example. If the at least one of the other encoding modes is the prediction encoding mode, the process of obtaining the coding demand value for the prediction encoding mode may include the following steps.

The number of bits for encoding the prediction encoding mode of the signal to be encoded is the sum of the number of bits required for encoding the residual signal of the signal to be encoded and the number of bits of the frame edge information of the signal to be encoded. The entropy coding is performed on the residual signal so as to obtain the number of bits required for encoding the residual signal. In the present embodiment, the residual signal is obtained based on the prediction order and the prediction coefficient. Then, entropy coding is performed on the residual signal based on the entropy coding parameters. Alternatively, the characteristic of the entropy coding can be utilized to simplify the calculation of the number of bits required for encoding the residual signal. Take Rice coding as an example. The input value is m. The Rice parameter is s. The number of bits required by this value is $k+1+s$, where $k=m>>(s-1)$. Therefore, there is no need to perform a complete entropy coding on the prediction residual signal. The required number of bits can be estimated according to the characteristic. Consequently, the complexity of the solution is reduced. The frame edge information includes a frame length parameter, a prediction parameter, and an entropy coding parameter. The frame length parameter is used to identify the number of sample points contained in the current frame. The prediction parameter indicates information required for linear prediction, such as prediction order and prediction coefficient. For the entropy coding parameters, take Rice coding as an example. In the Rice coding, to optimize the encoding efficiency, the corresponding parameters may vary as the signal varies. These parameters need to be encoded at the encoding end and sent to the decoder. In addition to the method for obtaining the coding demand value by encoding the input frame signal by frame with the prediction encoding mode, the coding demand value can be estimated according to the characteristics of the input signal frame.

The foregoing is based on the prediction encoding mode by way of example only. In this step, the coding demand values for various encoding modes can be obtained. The obtaining method is applicable to the encoding method different than the encoding mode itself. In this step, the demand encoding value can be obtained regardless of the encoding modes.

Before performing this step, analysis can be made on the input signal frame. Depending on the signal characteristic of the input frame signal, one or more encoding modes can be selected from various encoding modes to serve as the at least one of the other encoding modes so that the complexity in computing the coding demand value can be reduced.

In the present embodiment, the order of performing step 801 and step 802 can be switched, or step 801 and step 802 can be performed concurrently.

Step 803: The coding demand values for at least two encoding modes obtained at step 801 and step 802 are compared. An encoding mode for encoding the input signal frame is selected from the above encoding modes in accordance with the mode selection policy.

For the comparison step, various coding demand values obtained at step 802 may be compared in accordance with the mode selection policy first and further compared with the various coding demand values obtained at step 801 in accordance with the mode selection policy. Alternatively, various coding demand values obtained at step 801 and step 802 are compared together directly. The difference between the two approaches is that the two step comparison may adopt a different mode selection policy in each step of the comparison, whereas one step comparison simply adopts one mode selection policy.

The mode selection policy includes determining the minimum coding demand value from the obtained coding demand values. According to this mode selection policy, the first mode is selected as the encoding mode for encoding the input signal frame if the coding demand value required for the first mode is less than the coding demand value required for the second mode. A second encoding mode is selected as the encoding mode for encoding the input signal frame if the coding demand value required for the first mode is not less than the coding demand value required for the second mode. The mode selection policy further includes determining, from the obtained coding demand values, a coding demand value which is closest to the threshold. According to this mode selection policy, the coding demand values for these two modes are compared with a preset threshold. The encoding mode corresponding to the coding demand value having a smaller absolute value of the difference between the coding demand value and the threshold is selected for encoding the input signal frame. Alternatively, the encoding mode corresponding to the coding demand value smaller than the threshold is selected for encoding the input signal frame. The mode selection policy further includes adopting preferably one of the first encoding modes and at least one of the other encoding modes for performing encoding. In different environments, sometimes, there is a need to implement encoding in a preset encoding mode. Therefore, the mode which is employed first still exists. Of course, the mode policy for selecting, from the first encoding mode and the second encoding mode, an encoding mode for the input signal frame is not limited to the above types. The mode selection policy covers all the solutions which can be conceived by those skilled in the art. Take the two step comparison as an example. At the first step, the encoding modes corresponding to one or more coding demand values may be obtained based on step 802 where the encoding modes corresponding to the coding demand value smaller than a threshold serves as the encoding mode for the input signal frame. At the second step, the method for determining the minimum coding demand value is employed to determine the encoding mode for encoding the input signal frame.

Step 804: Information of the determined encoding mode and the encoded data which are encoded according to the determined encoding mode are encoded and multiplexed.

If the coding demand value is obtained, at step 801 and step 802, by way of encoding, then, at step 804, the information of the encoded mode and the encoding result obtained at step 801 or 802 are encoded and multiplexed, according to the encoding mode determined at step 803, with the parameters required for encoding in accordance with the encoding mode. The multiplexed result is output to the decoder. If the coding demand value is obtained by the estimation method employed at step 801 and step 802, then, at step 804, the input signal frame is encoded frame by frame using the encoding mode determined at step 803 to obtain the encoded data.

The encoded input signal frame, the encoding mode identifier, and the parameters required for encoding are multiplexed. The parameters required for encoding includes the number of sample points, minimum value of the sample points, and the number of bits required for encoding each sample point. Also, the parameters may include a prediction coefficient, a prediction order, and an entropy coding parameter, etc. The selected encoding mode is used to compress and encode the input signal frame.

If it is determined that the signal to be encoded employs the first encoding mode, the input signal frame is encoded by a dynamic range encoding module (taking the dynamic range encoding module as an example). The frame header information of the signal to be encoded, the information of the sample point value of the signal to be encoded and the encoding mode identifier corresponding to the dynamic range encoding mode are sent. The frame header information is the minimum value of the sample points of the signal to be encoded and the number of bits for encoding each sample point. The information of the sample value of the signal to be encoded is the sample value of the signal to be encoded. The frame header information of the signal to be encoded is encoded based on the encoding mode identifier corresponding to the dynamic range encoding mode. The information of the sample of the signal to be encoded is encoded bit by bit based on the number of bits required for encoding each sample.

According to the present embodiment, an encoding method is introduced to accommodate different encoding modes. By using a generic encoding method, effective switching is performed among different encoding modes based on the input signal frame and different coding policy when a signal is compressed and encoded. Accordingly, different requirements for complexity and compression efficiency can be met. Therefore, the compression efficiency is effectively enhanced by sacrificing less complexity.

Embodiment of a Decoding Method

Figure 8:
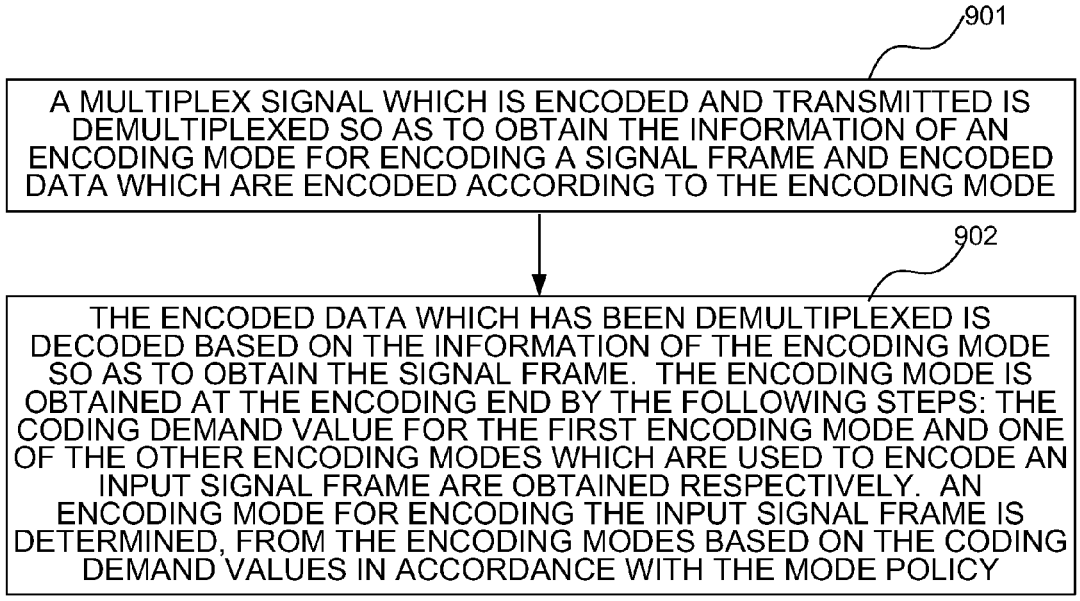
FIG. 8 is a flowchart of a decoding method according to an embodiment of the present invention.

FIG. 8 is a flowchart of a decoding method according to an embodiment of the present invention. The method includes the following steps.

Step 901: A multiplexed signal which is encoded and transmitted is demultiplexed so as to obtain the information of an encoding mode for encoding a frame signal and encoded data which are encoded according to the encoding mode.

Step 902: The encoded data which has been demultiplexed is decoded based on the information of the encoding mode so as to obtain the frame signal. The encoding mode is obtained at the encoding end in accordance with the following steps.

The coding demand value for the first encoding mode and one of the other encoding modes which are used to encode an input frame signal are obtained. An encoding mode for encoding the input frame signal is determined, from the encoding modes based on the coding demand values in accordance with the mode selection policy.

The multiplexed signal is demultiplexed and the signal to be decoded and the encoding mode identifier are sent to a decoding unit. Take the prediction mode as an example. If the signal to be encoded employs a prediction encoding mode, the prediction coefficient, the prediction order and the entropy coding parameters are also obtained. A decoding mode for decoding the signal to be decoded is determined based on the demultiplexed encoding mode identifier. If the encoding mode corresponding to the encoding mode identifier is a dynamic range encoding mode, the decoding mode for the signal to be decoded is a dynamic range decoding mode. Then, information of the frame header of the signal to be decoded and information of the sample point value are decoded and the signal is reconstructed losslessly according to the decoded header information and the information of the sample point value. If the encoding mode corresponding to the encoding mode identifier is another encoding mode, it is determined that the decoding mode for decoding the signal to be decoded is a decoding mode corresponding to the other decoding mode, such as a prediction decoding mode. Take the prediction decoding mode as an example. Residual signals are obtained by performing an entropy decoding on the signal to be decoded according to the entropy encoding parameters. The residual signals are combined based on the demultiplexed prediction coefficient and the prediction order so that a signal is reconstructed losslessly.

According to the present embodiment, a decoding method is introduced to accommodate different decoding modes. By using a generic decoding method and decoding the signal using a reverse process of the encoding process, effective switching is performed among different encoding modes based on the input signal frame and different coding policy when a signal is compressed and encoded. Accordingly, different requirements for complexity and compression efficiency can be met. Therefore, the compression/decompression efficiency is effectively enhanced by sacrificing less complexity.

Embodiment of an Encoding Apparatus

Figure 9:
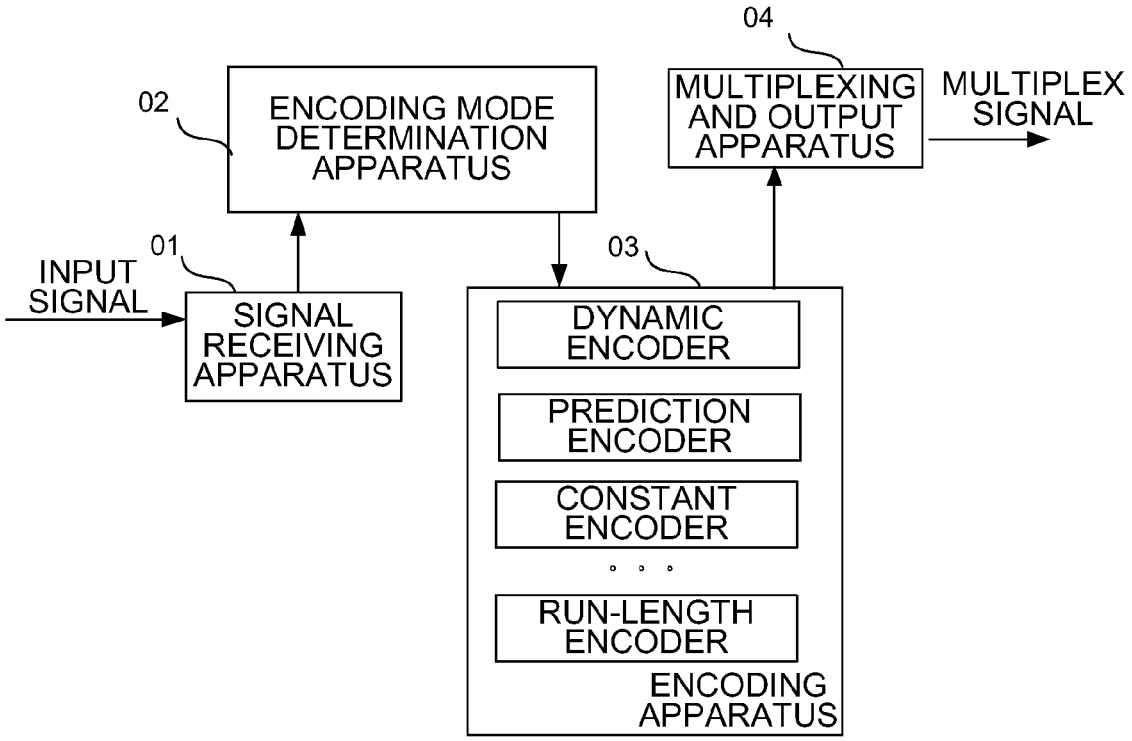
FIG. 9 is a flowchart of an encoding system according to an embodiment of the present invention.

FIG. 9 illustrates a diagram of an encoding system according to an embodiment of the present invention. The system includes a signal receiving apparatus 01, an encoding mode determination apparatus 02, an encoding apparatus 03 and a multiplexing and output apparatus 04.

The signal input apparatus 01 is configured to receive an input signal frame. The output signal is a signal to be encoded. The encoding mode determination apparatus 02 is configured to analyze the signal characteristic of the input frame signal, select a second encoding mode for encoding the input frame signal, obtain coding demand values for a preset first encoding mode and the second encoding mode which are used to encode the input frame signal; and determine, from the above encoding modes based on the coding demand values, an encoding mode for encoding the input frame signal. The encoding apparatus 03 is configured to encode the input frame signal using the determined encoding mode. The multiplexing and output apparatus 04 is configured to multiplex information of the determined encoding mode and encoded data which are encoded according to the determined encoding mode.

The encoding apparatus 03 is comprised of encoders which perform with different encoding modes. The encoding mode determination apparatus 02 may be coupled to the encoding apparatus 03, or may be coupled to the multiplexing and output apparatus 04. When the encoding mode determination apparatus 02 is coupled to the encoding apparatus 03, the encoding mode determination apparatus 02 obtains an estimate of the coding demand value by way of an estimation method. After the encoding mode for encoding the input frame signal is determined, the determined encoding mode is sent to the encoding apparatus 03 which then encodes the input signal frame with the encoding mode and sends the encoding result to the multiplexing and output apparatus 04. The multiplexing and output apparatus 04 sends the multiplexed data to the decoder for decoding. When the encoding mode determination apparatus 02 is coupled to the multiplexing and output apparatus 04, the encoding apparatus 03 and the encoding mode determination apparatus 02 may be in a logic entity or may be located within the encoding mode determination apparatus 02, or may be separate logic entities. The process that the encoding mode determination apparatus 02 obtains the coding demand value includes using the encoding apparatus 03 to obtain the coding demand value required for encoding by employing an encoding mode to perform the encoding. After the encoding mode for encoding the input frame signal is determined, the data encoded with the encoding mode, the mode identifier and the encoding parameters are sent to the multiplexing and output apparatus. The multiplexing and output apparatus multiplexes the received data and outputs the multiplexed result to the decoder for decoding.

According to the present embodiment, an encoding system is introduced to accommodate different encoding modes. By using a generic encoding system, effective switching is performed among different encoding modes based on the input signal frame and different coding policy when a signal is compressed and encoded. Accordingly, different requirements for complexity and compression efficiency can be met. Therefore, the compression efficiency is effectively enhanced by sacrificing less complexity.

In the above embodiments, the encoding operation under different encoding modes is performed by different encoders, including a dynamic range encoder, a constant encoder, a prediction encoder, etc. The input signal frame may be a PCM signal, like a signal encoded point by point under G. 711 standard, or other signal which is applicable to the above operations in the embodiments, or signals which can be unambiguously conceived from the above embodiments by those skilled in the art.

It is appreciated by those skilled in the art that the entire or partial procedure of the methods according to the aforementioned embodiments may be implemented with related hardware when instructed by computer program. The program may be stored in a computer readable storage media. During execution, the program may include the procedures of the methods according to various embodiments as mentioned above. The storage media may be a magnetic disc, an optical disc, a Read-Only Memory (ROM) or a Random Access Memory (RAM), etc.

It should be noted that the foregoing embodiments are merely illustrations for the technical solutions of the present invention, as the invention is not so limited. Although preferred embodiments are provided for illustration of the present invention, it is appreciated by a person of ordinary skill in the art that any modifications or equivalents may be made to the technical solutions of the present invention without departing from the spirit and scope of the technical solutions of the present invention.

What is claimed is:

1. An audio encoding method, the method comprising:

selecting a second encoding mode for encoding an input frame signal according to an analysis on signal characteristics of the input frame signal;

obtaining coding demand values for a preset first encoding mode and the second encoding mode which are used to encode the input frame signal;

determining, from the preset first encoding mode and the second encoding mode based on the coding demand values, an encoding mode for encoding the input frame signal; and multiplexing information of the determined encoding mode and encoded data which are encoded according to the determined encoding mode;

wherein the second encoding mode is selected from a group that does not comprise the first encoding mode.

2. The method of claim 1, wherein the second encoding mode for encoding the input frame signal is selected based on the analysis on the characteristics of the input frame signal in accordance with a signal analysis policy, and wherein the signal analysis policy comprises:

analyzing various signal characteristics of the input frame signal, and selecting an encoding mode corresponding to the signal characteristics of the input frame signal; or employing a prediction encoding mode for the input frame signal whose signal characteristics do not match preset characteristics.

3. The method of claim 2, wherein analyzing various signal characteristics of the input frame signal and selecting an encoding mode corresponding to the signal characteristics of the input frame signal comprises:

analyzing the signal characteristics of the input frame signal according to the signal characteristics' priority; and selecting the encoding mode corresponding to the signal characteristic which first matches a preset condition.

4. The method of claim 1, wherein the second encoding mode for encoding the input frame signal is selected based on the analysis on the characteristics of the input frame signal in accordance with a signal analysis policy, and wherein the signal analysis policy comprises:

if the input signal frame is a constant signal, selecting constant encoding mode as the second encoding mode.

5. The method of claim 1, wherein the second encoding mode for encoding the input frame signal is selected based on the analysis on the characteristics of the input frame signal in accordance with a signal analysis policy, and wherein the signal analysis policy comprises:

if the whole input signal frame includes two values, selecting multi-valued encoding mode as the second encoding mode.

6. The method of claim 1, wherein the second encoding mode for encoding the input frame signal is selected based on the analysis on the characteristics of the input frame signal in accordance with a signal analysis policy, and wherein the signal analysis policy comprises:

if the number of pulses of the input signal frame is less than K, selecting pulse encoding mode as the second encoding mode.

7. The method of claim 1, wherein after the selecting the second encoding mode for encoding the input frame signal according to the analysis on signal characteristics of the input frame signal, the method further comprises:

identifying whether the second encoding mode is a prediction mode; and if the second encoding mode is not the prediction mode, encoding the input frame signal with the second encoding mode, and multiplexing the information of the determined encoding mode and the encoded data which are encoded with the determined encoding mode.

8. The method of claim 1, wherein the encoding mode for encoding the input frame signal is determined based on the coding demand values in accordance with a mode selection policy, and wherein the mode selection policy comprises:

determining a minimum coding demand value from the obtained coding demand values;

determining, from the coding demand values obtained, a coding demand value closest to a threshold; or adopting preferably one of the first encoding mode and at least one of the other encoding modes for performing encoding.

9. The method of claim 8, wherein the coding demand value comprises one or both of the number of bits and the number of bytes required for encoding the input frame signal.

10. The method of claim 1, wherein the coding demand value comprises one or both of the number of bits and the number of bytes required for encoding the input frame signal.

11. The method of claim 1, wherein the first encoding mode is a dynamic range encoding mode.

12. An audio encoding apparatus, the apparatus comprising:

a signal analysis unit configured to analyze signal characteristics of an input frame signal and select a second encoding mode to encode the input frame signal;

a coding demand estimation unit configured to estimate coding demand values for a preset first encoding mode and the second encoding mode, which are used to encode the input frame signal;

a mode determination unit configured to determine, from the preset first encoding mode and the second encoding mode based on the coding demand values, an encoding mode for encoding the input frame signal; and an encoding unit configured to encode the input frame signal using the determined encoding mode;

wherein the second encoding mode is selected from a group that does not comprise the first encoding mode.

13. The apparatus of claim 12, wherein the signal analysis unit analyses the signal characteristics of the input frame signal and selects the second encoding mode for encoding the input frame signal in accordance with a signal analysis policy, and wherein the signal analysis policy comprises:

analyzing various signal characteristics of the input frame signal, and selecting an encoding mode corresponding to the signal characteristics of the input frame signal; or employing a prediction encoding mode for the input frame signal whose signal characteristics do not match preset characteristics.

14. The apparatus of claim 12, wherein the signal analysis unit analyses the signal characteristics of the input frame signal and selects the second encoding mode for encoding the input frame signal in accordance with a signal analysis policy, and wherein the signal analysis policy comprises:

if the input signal frame is a constant signal, selecting constant encoding mode as the second encoding mode.

15. The apparatus of claim 12, wherein the mode determination unit is configured to determine, from the preset first encoding mode and the second encoding mode based on the coding demand values in accordance with a mode selection policy, an encoding mode for encoding the input frame signal, and wherein the mode selection policy comprises:

determining a minimum coding demand value from the obtained coding demand values;

determining, from the obtained coding demand values, a coding demand value closest to a threshold; or adopting preferably one of the first encoding mode and at least one of the other encoding modes for performing encoding.

16. The apparatus of claim 12, wherein the coding demand value comprises one or both of the number of bits and the number of bytes required for encoding the input frame signal.

17. The apparatus of claim 12, wherein the first encoding mode is a dynamic range encoding mode.

18. An encoding system, the system comprising:

a signal receiving apparatus configured to receive an input frame signal;

an encoding mode determination apparatus configured to analyze signal characteristics of the input frame signal, select a second encoding mode for encoding the input frame signal, obtain coding demand values for a preset first encoding mode and the second encoding mode which are used to encode the input frame signal, and determine, from the preset first encoding mode and the second encoding mode based on the coding demand values, an encoding mode for encoding the input frame signal;

an encoding apparatus configured to encode the input frame signal using the determined encoding mode; and a multiplexing and output apparatus configured to multiplex information of the determined encoding mode and encoded data which are encoded according to the determined encoding mode;

wherein the second encoding mode is selected from a group that does not comprise the first encoding mode.

* * * * *